US007347336B1

(12) United States Patent
Williams et al.

(10) Patent No.: US 7,347,336 B1
(45) Date of Patent: Mar. 25, 2008

(54) SHELVING

(75) Inventors: Eric V. Williams, Paragould, AR (US); Charles J. Sharpe, II, Paragould, AR (US)

(73) Assignee: L.A. Darling Company

( * ) Notice: Subject to any disclaimer, the term of this patent is extended or adjusted under 35 U.S.C. 154(b) by 57 days.

(21) Appl. No.: 11/288,782

(22) Filed: Nov. 29, 2005

(51) Int. Cl.
*A47F 5/08* (2006.01)

(52) U.S. Cl. ..... 211/153; 108/108; 52/528

(58) Field of Classification Search ..... 211/153, 211/135, 90.01, 90.02, 90.04, 186, 149, 72, 211/192; 108/57.32, 51.11, 99–101, 106–108, 108/162, 165, 171, 147.11, 147.15–147.17, 108/152; 248/247, 248, 235, 241, 242, 250, 248/220.21, 220.22; 312/258–259; 52/528, 52/545

See application file for complete search history.

(56) References Cited

U.S. PATENT DOCUMENTS 1,343,818 A * 6/1920 Grammich ..... 211/153
1,711,329 A 4/1929 Short
4,709,642 A 12/1987 Briosi
4,742,925 A * 5/1988 Henderson ..... 211/71.01
4,958,739 A * 9/1990 Spamer ..... 211/153
5,036,778 A 8/1991 Briosi
5,921,411 A * 7/1999 Merl ..... 211/90.01
6,082,557 A * 7/2000 Leahy ..... 211/59.3
6,520,353 B2 * 2/2003 Fulbright ..... 211/153
6,641,098 B1 11/2003 Profitt

OTHER PUBLICATIONS

Madix, Inc. www.madixinc.com.
Lozier Corporation www.lozier.com.

* cited by examiner

*Primary Examiner*—Brian E. Glessner
*Assistant Examiner*—Candace L. Bradford
(74) *Attorney, Agent, or Firm*—Joe D. Calhoun

(57) ABSTRACT

A shelving improvement including a cooperating pair of vertical rib sections downstanding essentially beneath an abutment of adjacent sub-shelf edges, each vertical rib section including double-back sections for strengthening, each vertical rib section also including a fulcrum-wedge curve wedging between offset curves and front and rear lower vertical segments and leveraging sub-shelf edges into close continuing alignment.

20 Claims, 3 Drawing Sheets

SHELVING

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION (1) Field of the Invention

This invention relates to an improved manner of constructing a shelf for supporting and displaying merchandise on retail shelves or "gondolas". More particularly, the present invention includes a manner of constructing a strengthened shelf having sub-shelf portions, facilitating leveraging of the sub-shelf portions into close continuing alignment at an abutment of the edges.

(2) Description of Related Art Including Information Disclosed 37 CFR 1.97 and 1.98

Known in the art are various shelves and shelving systems, such as the shelving offered by:

(1) Lozier Corporation; and (2) Madix Inc.

Moreover, the following patents are arguably related to the patentability of the subject invention:

U.S. Pat. No. 1,343,818 issued to Grammich discloses a shelf having an essentially horizontally-compressed rib extending the width of the shelf and resembling a squashed "W" in cross-section. The unitary-construction shelf includes at least two sub-shelf portions having almost-abutting edges, separated by a gap. Both respective sub-shelf portions are unified beneath by a folded rib, each respective section of which comprises an initial extension from its respective sub-shelf edge curving downwardly through the gap and splaying back along the underside of its respective sub-shelf; it then essentially returns to the gap, looping back upon itself and curving up to the gap, where it merges into the mirror-image counterpart section of the rib extending from the other respective sub-shelf. The merge-point essentially forms an upstanding ridge along the midpoint of the squashed W, situated in the gap between downturning curves of horizontal sub-shelf portions. The upper half of each looping section lies against the underside of the respective sub-shelf, each looping section having a bracing or supporting function for the strip of sub-shelf atop each loop. The horizontally-splayed looping of the rib produces a resiliency so that the strips of sub-shelfs between the widely separated loops will yield when a load is placed atop the shelf; the gravitational force exerted on the strips of sub-shelfs between the loops will be depressed downwardly, causing the strips of sub-shelfs to sink slightly until the mid-rib ridge occupies much of the gap between the two sub-shelfs. The Grammich patent does not disclose a vertically-compressed W-shaped rib providing rigidity, strength and leveraging to the abutment directly above it.

U.S. Pat. No. 6,520,353 issued to Fulbright discloses a shelf having ribs formed by a single fold of shelving material directly below the abutment of downturning edges of horizontal sub-shelf portions. The Fulbright patent does not disclose a vertically-compressed W-shaped rib providing rigidity, strength and leveraging to the abutment directly above it.

U.S. Pat. No. 5,036,778 issued to Briosi discloses modular shelving having a crosspiece with projecting folds forming ribs that stiffen the crosspiece. The Briosi '778 patent does not disclose a vertically-compressed W-shaped rib providing rigidity, strength and leveraging to the abutment directly above it.

BRIEF SUMMARY OF THE INVENTION

Although the present invention has several embodiments, the invention described essentially comprises an improvement to shelving, the improvement including a cooperating pair of vertical rib sections downstanding essentially beneath an abutment of adjacent sub-shelf portions, each vertical rib section including double-back sections of shelf material.

FIG. 1 depicts a perspective view of a shelf having what appears to be two parallel longitudinal lines running the width of the shelf. When looking at the side of the shelf in cross section (FIG. 2), each of those parallel lines is formed by the abutting two edges of horizontal sheet metal shelving; both horizontal sections (1 and 15) of shelving descend essentially vertically (perpendicularly) starting about at the point of contact with the other horizontal section of shelving, then each downstanding vertical portion doubles back upwardly (against itself and against the corresponding doubled-back segment of the other vertical portion of the other horizontal section of shelving) until joining (merging into) the other corresponding vertical portion of the other horizontal section of shelving about half way up toward the shelf.

Although the invention has a number of features and variations, its most general form includes a pair of vertical folds directly beneath the abutment of horizontal sections of shelving; the folds are compressed laterally until aligned essentially vertically, and parallel to the adjacent fold. Other features may include the dimensions and angulation needed to facilitate the "pinching" abutment of horizontal sections, to discourage the passage of particles or liquid (especially food and beverage) therebetween, and the leveraging necessary for the continuation of that pinching abutment while the shelf is supporting merchandise.

One primary object of the present invention is to provide an improved manner of constructing a strengthened shelf.

Another primary object of the present invention is to provide an improved manner of constructing a shelf having sub-shelf portions, facilitating leveraging of the sub-shelf portions into close continuing alignment at an abutment of the edges.

It is another object of the present invention to provide an improved manner of constructing a single-piece shelf.

It is another object of the present invention to provide a manner of constructing an improved shelf economically.

Other objects will be apparent from a reading of the written description disclosed herein, together with the claims.

BRIEF DESCRIPTION OF THE SEVERAL VIEWS OF THE DRAWINGS

FIGS. 1 through 4 illustrate certain details of certain embodiments. However, the invention disclosed herein is not limited to only the embodiments so illustrated. The invention disclosed herein may have equally effective or legally equivalent embodiments.

DETAILED DESCRIPTION OF THE INVENTION

Figure 1:
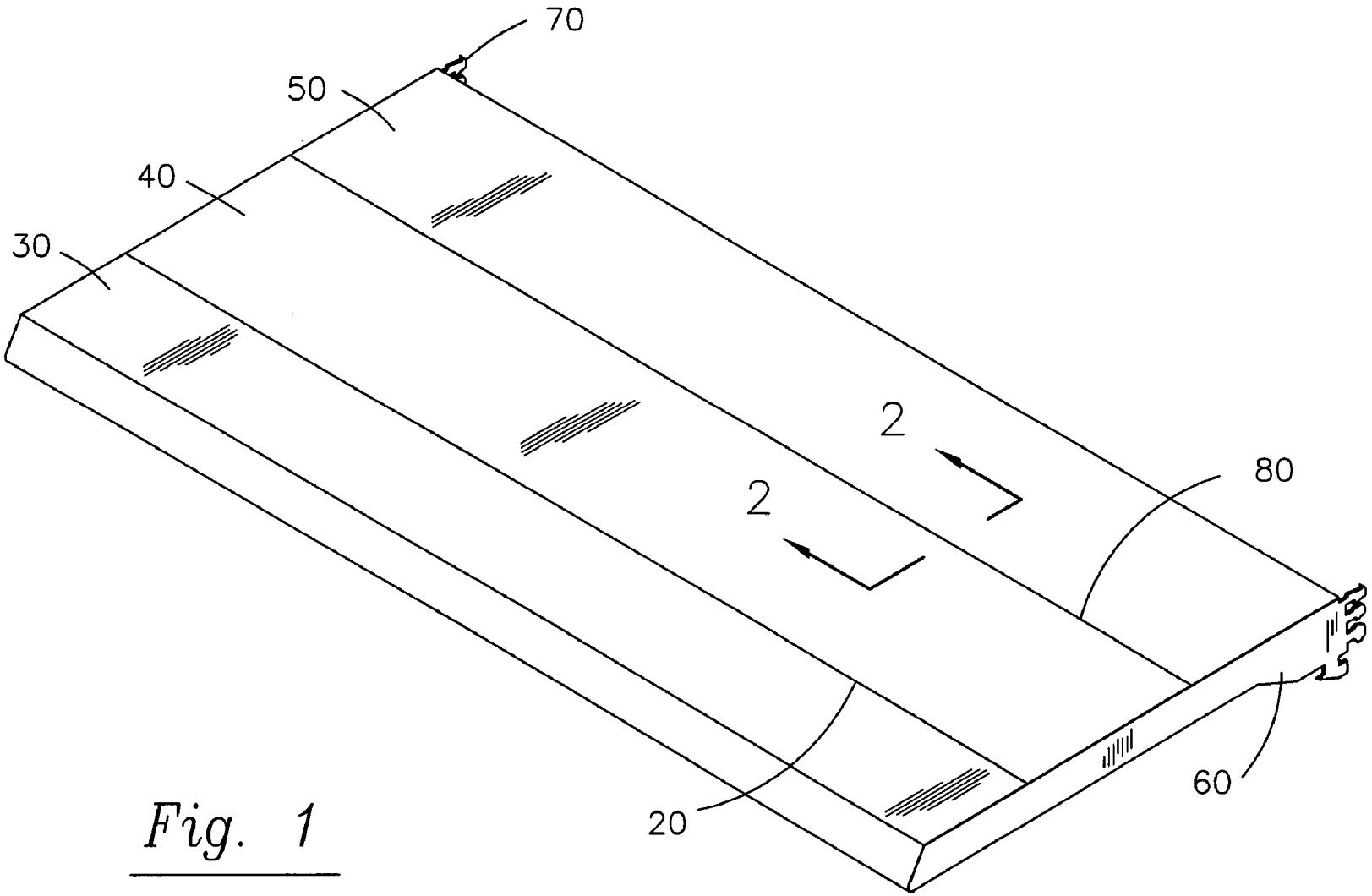
FIG. 1 depicts a perspective view of the top of a shelf including three abutting horizontal sub-shelf portions (30, 40 and 50), a right side bracket (60) and a left side bracket (70, partially hidden), and abutments (20 and 80).
Figure 2:
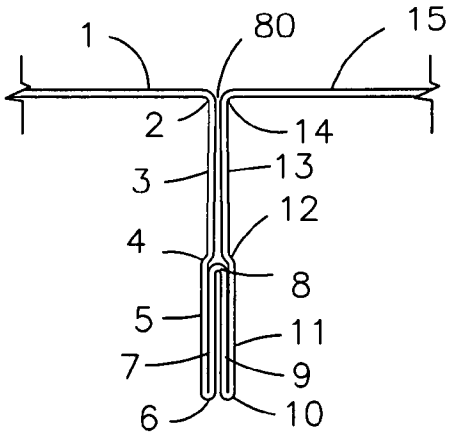
FIG. 2 depicts a side elevation view of a cross-section partial view (across abutment 80) of the shelf depicted in FIG. 1, at 2-2.
Figure 3:
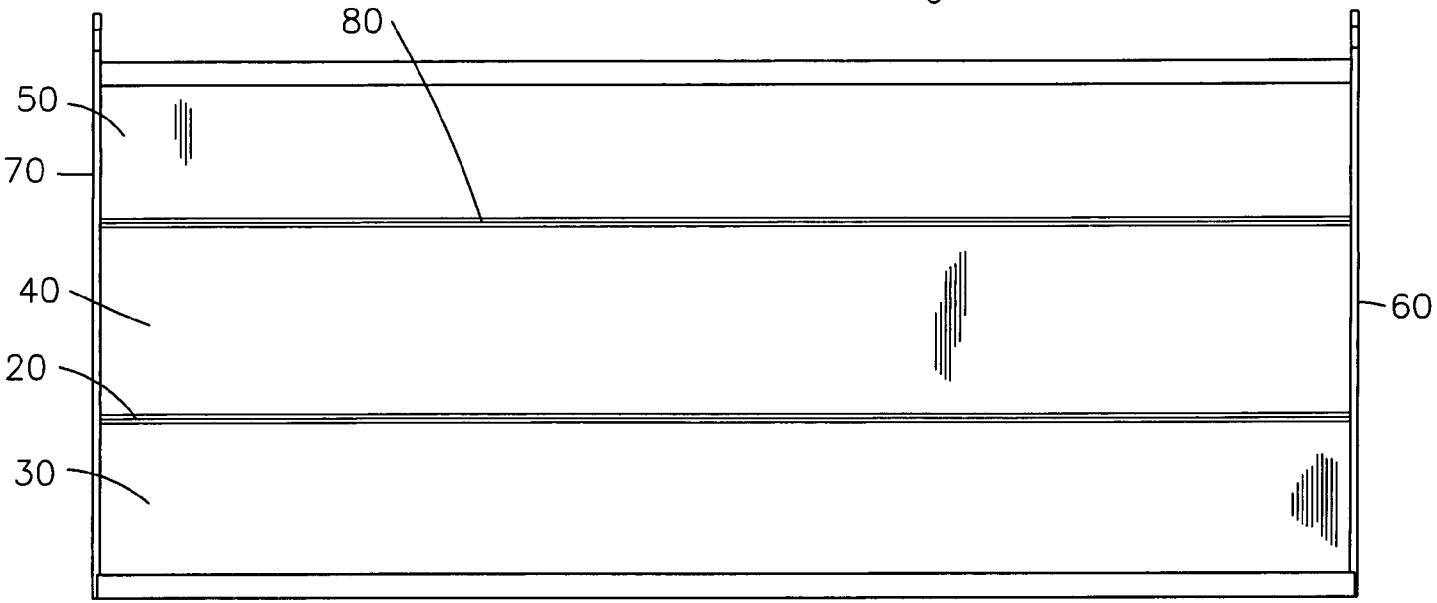
FIG. 3 depicts a bottom plan view of the shelf depicted in FIG. 1.
Figures 4, 5:
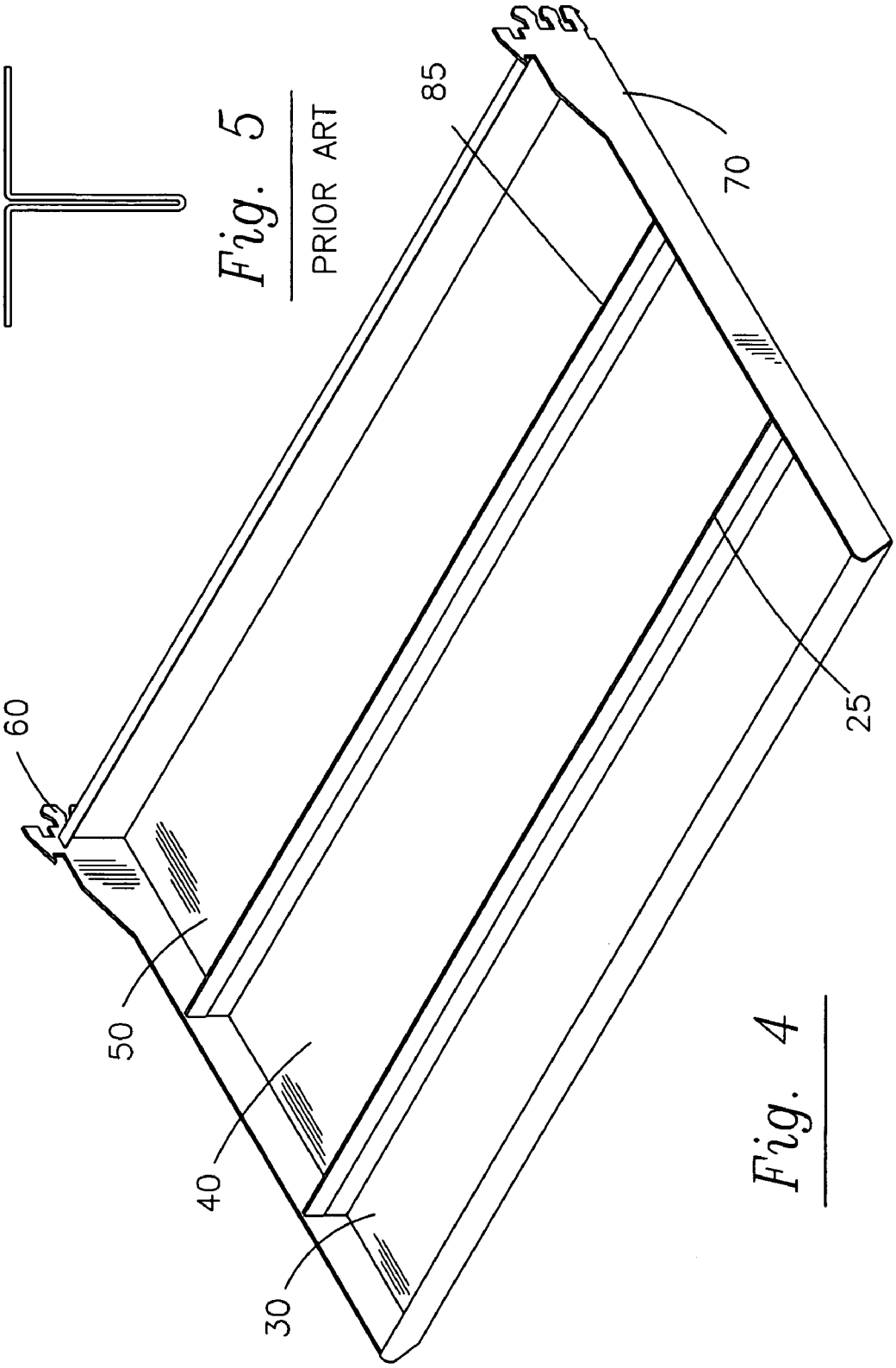
Fig. 5 PRIOR ART
FIG. 4 depicts a perspective view of the underside of a shelf including three abutting horizontal sub-shelf portions (30, 40 and 50), a right side bracket (60, partially hidden) and a left side bracket (70), and ribs (25 and 85).
FIG. 5 depicts a side cross-section partial view of a shelf manufactured by L. A. Darling Co., at a plane having a location substantially similar to the location of the plane depicted in FIG. 1 at 2-2; this is consistent with FIG. 7 of U.S. Pat. No. 6,520,353 issued to Fulbright, assigned to L. A. Darling.

For the sake of simplicity and to give the claims of this patent application the broadest interpretation and construction possible, the following definitions will apply:

The term "shelf" essentially means a horizontal member capable of resisting downward gravitational pressure exerted by something situated atop the shelf; the term "sub-shelf" essentially means a portion of a shelf, even though the shelf member may be of unitary, single-piece construction.

The term "rib" essentially means a member downstanding below a shelf, often beneath an abutment of adjacent sub-shelfs.

The term "front" or derivative thereof essentially means the part of a sub-shelf or the segment of a rib relatively further from the wall, or other vertical support for the shelving; alternatively, the part of a sub-shelf or segment of a rib relatively closer to the pedestrian aisle faced by the shelving.

The term "rear" or derivative thereof essentially means the part of a sub-shelf or the segment of a rib relatively closer to the wall, or other vertical support for the shelving; alternatively, the part of a sub-shelf or segment of a rib relatively further from the pedestrian aisle faced by the shelving.

Also for the sake of simplicity, the conjunctive "and" may also be taken to include the disjunctive "or," and vice versa, whenever necessary to give the claims herein the broadest interpretation and construction possible. Likewise, when the plural form is used, it may be taken to include the singular form, and vice versa.

The invention disclosed herein is not limited by construction materials to the extent that such materials satisfy the structural and/or functional requirements of any claim. For example, although shelf material essentially comprises sheet metal, it may include any material capable of resisting downward gravitational pressure exerted by something situated atop the shelf; and although rib material essentially comprises sheet metal, it may include any material capable of providing the vertical support, and/or the horizontal leveraging needed to maintain close continuing alignment of the abutment of adjacent sub-shelfs described herein. Such materials may include (for example) alloys, polymers and plastics of all types, and mixtures and combinations thereof.

Although the invention has a number of features and variations, its most general form includes and improvement that includes (comprises) at least one cooperating pair of vertical rib sections downstanding essentially beneath an abutment of adjacent sub-shelf portions, each vertical rib section including double-back sections of shelf material.

In one general version of the invention, each of said rib sections comprises a downturn corner (2 or 14) at said abutment (20). Another feature includes an upper vertical segment (3 or 13). Another feature includes an offset curve (4 or 12). Yet another feature includes an outer lower vertical segment (5 or 11). Yet another feature includes a double-back curve (6 or 10). Still another feature includes an inner double-back segment (7 or 9), and a fulcrum wedge; one version includes a pair of inner double-back segments, merging at an upper extremity and defining a fulcrum-wedge curve (8).

One version of the invention includes said downturn corners comprising a front downturn corner (2) and a rear downturn corner (14). More particularly, said downturn corners may be in the range of between about eighty-nine and ninety-nine one-hundredths degrees (89.99°) and eighty-eight degrees (88°). Even more particularly, said downturn corners are each about 89°.

In one version of the invention, said upper vertical segments comprise a front upper vertical segment (3) and a rear upper vertical segment (13).

In another version of the invention, said offset curves comprise a front offset curve (4) and a rear offset curve (12).

In another version of the invention, said outer lower vertical segments comprise a front outer lower vertical segment (5) and a rear outer lower vertical segment (11).

In yet another version of the invention, said double-back curves comprise a front double-back curve (6) and a rear double-back curve (10).

In yet another version of the invention, said inner double-back segments comprise a front inner double-back segment (7) and a rear inner double-back segment (9).

In still another version of the invention, said fulcrum-wedge curve (8) wedges between said offset curves (4 and 12) and said front and rear lower vertical segments (5 and 7, and 9 and 11), providing leveraging of said front and rear downturn corners (2 and 14) into close continuing alignment at said abutment (20).

In one improved shelf, said front and rear upper vertical segments have a length about equal to said front and rear lower vertical segments. More particularly, said front and rear upper vertical segments may have a length in the range of between about one-quarter (¼) inch and one inch; moreover, and said front and rear lower vertical segments may have a length in the range of between about one-quarter (¼) and one inch. Even more particularly, said front and rear upper vertical segments may have a length of about three-quarter (¾) inch; moreover, said front and rear lower vertical segments may have a length of about thirty-seven sixty-fourths (37/64) inch.

In one version of the invention disclosed herein, said cooperating pair of vertical rib sections provide support along said abutment against downward gravitational force exerted on said shelf by a load placed atop the shelf. The invention also includes a version wherein said cooperating pair of vertical rib sections provide leveraging along said abutment sufficient to assure close continuous alignment of said sub-shelf sections. Said close continuous alignment of said sub-shelf sections may be sufficient to impair the passage of particles therebetween. Said close continuous alignment of said sub-shelf sections may even be sufficient to impair the passage of fluid therebetween.

A most particular version of the improvement comprises a cooperating pair of vertical rib sections downstanding essentially beneath an abutment of adjacent sub-shelf portions, each vertical rib section including double-back segments of shelf material;

(a) each of said rib sections comprising a pair of downturn corners at said abutment, a pair of upper vertical segments, a pair of offset curves, a pair of outer lower vertical segments, a pair of double-back curves and a pair of inner double-back segments, said inner double-back segments merging at an uppermost extremity and defining a fulcrum-wedge curve;

(b) said downturn corners comprising a front downturn corner and a rear downturn corner, each about 89°;

(c) said upper vertical segments comprising a front upper vertical segment and a rear upper vertical segment, each having a length of about three-quarter (¾) inch;

(d) said offset curves comprising a front offset curve and a rear offset curve;

(e) said outer lower vertical segments comprising a front outer lower vertical segment and a rear outer lower vertical segment, each having a length of about thirty-seven sixty-fourths (37/64) inch;

(f) said double-back curves comprising a front double-back curve and a rear double-back curve;

(g) said inner double-back segments comprising a front inner double-back segment and a rear inner double-back segment; and (h) said fulcrum-wedge curve wedging between said offset curves and said front and rear lower vertical segments and leveraging said front and rear downturn corners into close continuing alignment at said abutment.

The invention disclosed herein includes improved shelving comprising the improvement described hereinabove in combination with sub-shelfs, and any other parts necessary for implementing the improvement.

The improved shelving may be manufactured in accordance with standard manufacturing techniques known in the field. First, a flat blank is sent through a perforator where rows of perforations are punched into the blank. The blank is then situated onto a conveyor where it is fed into the roll former. The roll former forms the front and back forms along with the laterally-compressed standing rib(s).

Those skilled in the art who have the benefit of this disclosure will appreciate that it may be used as the creative basis for designing devices or methods similar to those disclosed herein, or to design improvements to the invention disclosed herein; such new or improved creations should be recognized as dependant upon the invention disclosed herein, to the extent of such reliance upon this disclosure.

We claim:

1. A shelf wherein an improvement comprises:

(a) a cooperating pair of essentially vertical linear rib sections downstanding essentially beneath an abutment of adjacent sub-shelf portions, each vertical rib section including a downturn corner at said abutment, an upper vertical linear segment, an outer lower vertical linear segment on a nearby vertical plane offset away from said abutment, and an intermediate offset curve allowing each of said vertical linear segments to be in a separate adjacent vertical plane near that of the other vertical linear segment; and (b) a fulcrum-wedge immediately below said offset curves, providing separation between said outer lower vertical linear segments.

2. An improvement described in claim 1 above, each of said rib sections further comprising a a double-back curve at the lowermost extremity of said outer lower vertical linear segment, an inner double-back linear segment vertically contiguous with and almost the same length as said outer lower vertical linear segment and having a length in a range of about one-fourth to about three-fourths of the vertical distance from said downturn corner to said double-back curve, said inner double-back linear segment terminating in a juncture with the termination of the inner double-back linear segment of the other cooperating vertical rib section to thereby define said fulcrum-wedge.

3. An improvement described in claim 2 above, said double-back curves comprising a front double-back curve (6) and a rear double-back curve (10).

4. An improvement described in claim 2 above, said inner double-back segments comprising a front inner double-back segment (7) and a rear inner double-back segment (9), said inner double-back segments merging at an upper extremity and defining a fulcrum-wedge curve (8).

5. An improvement described in claim 4 above, said fulcrum-wedge curve wedging between said offset curves and said front and rear lower vertical segments and leveraging said front and rear downturn corners into close continuing alignment at said abutment.

6. An improvement described in claim 5 above, said front and rear upper vertical segments having a length about equal to said front and rear lower vertical segments.

7. An improvement described in claim 5 above, said front and rear upper vertical segments having a length in a range of between about one-quarter (¼) inch and one inch, and said front and rear lower vertical segments having a length in the range of between about one-quarter (¼) inch and one inch.

8. An improvement described in claim 5 above, said front and rear upper vertical segments having a length of about three-quarter (¾) inch, and said front and rear lower vertical segments having a length of about thirty-seven sixty-fourths (37/64) inch.

9. An improvement described in claim 1 above, said downturn corners comprising a front downturn corner (2) and a rear downturn corner (14).

10. An improvement described in claim 1 above, wherein said downturn corners are each in a range of between about 89.99° and 88°.

11. An improvement described in claim 1 above, wherein said downturn corners are each about 89°.

12. An improvement described in claim 1 above, said upper vertical linear segments comprising a front upper vertical linear segment (3) and a rear upper vertical linear segment (13).

13. An improvement described in claim 1 above, said offset curves comprising a front offset curve (4) and a rear offset curve (12).

14. An improvement described in claim 1 above, said outer lower vertical linear segments comprising a front outer lower vertical linear segment (5) and a rear outer lower vertical linear segment (11).

15. An improvement described in claim 1 above, said cooperating pair of vertical rib sections providing support along said abutment against downward gravitational force exerted on said shelf.

16. An improvement described in claim 1 above, said cooperating pair of vertical rib sections providing leveraging along said abutment sufficient to assure close continuous alignment of said sub-shelf sections.

17. An improvement described in claim 16 above, wherein said close continuous alignment of said sub-shelf sections is sufficient to impair the passage of particles therebetween.

18. An improvement described in claim 16 above, wherein said close continuous alignment of said sub-shelf sections is sufficient to impair the passage of fluid therebetween.

19. An improvement to shelving, the improvement comprising a cooperating pair of essentially vertical linear rib sections downstanding essentially beneath an abutment of adjacent sub-shelf portions, each vertical rib section including double-back linear segments of shelf material;

(a) each of said rib sections comprising a downturn corner at said abutment, an upper vertical linear segment, an offset curve, an outer lower vertical linear segment, a double-back curve, and an inner double-back linear segment, said inner double-back segments merging at an uppermost extremity and defining a fulcrum-wedge curve;

(b) said downturn corners comprising a front downturn corner and a rear downturn corner, each about 89°;

(c) said upper vertical segments comprising a front upper vertical segment and a rear upper vertical segment, each having a length of about three-quarter (3/4) inch;

(d) said offset curves comprising a front offset curve and a rear offset curve;

(e) said outer lower vertical segments comprising a front outer lower vertical segment and a rear outer lower vertical segment, each having a length of about thirty-seven sixty-fourths (37/64) inch;

(f) said double-back curves comprising a front double-back curve and a rear double-back curve;

(g) said inner double-back segments comprising a front inner double-back segment and a rear inner double-back segment; and (h) said fulcrum-wedge curve wedging between said offset curves and said front and rear lower vertical segments, and leveraging said front and rear downturn corners into close continuing alignment at said abutment.

20. Improved shelving comprising the improvement described in claim 1 above in combination with sub-shelf portions.

* * * * *